US005494122A

United States Patent [19]

Larsen et al.

[11] Patent Number: 5,494,122

[45] Date of Patent: Feb. 27, 1996

[54] COMPOSITE NOZZLES FOR ROCK BITS

[75] Inventors: James L. Larsen, Spring; Michael A. Siracki; Thomas W. Oldham, both of The Woodlands, all of Tex.; Madapusi K. Keshavan, Sandy, Utah

[73] Assignee: Smith International, Inc., Houston, Tex.

[21] Appl. No.: 317,969

[22] Filed: Oct. 4, 1994

[51] Int. Cl.[6] ..... E21B 10/18

[52] U.S. Cl. ..... 175/340; 175/393

[58] Field of Search ..... 175/340, 393, 175/422, 424; 239/591

[56] References Cited

U.S. PATENT DOCUMENTS 3,111,179 11/1963 Albers et al. .
3,744,581 7/1973 Moore ..... 175/424 X
4,301,877 11/1981 Cloud .
4,392,534 7/1983 Miida .
4,533,005 8/1985 Morris .
4,665,999 5/1987 Shoemaker .
4,687,067 8/1987 Smith et al. .
4,711,311 12/1987 Underwood et al. .
5,072,796 12/1991 Shen et al. ..... 175/424 X

*Primary Examiner*—William P. Neuder
*Attorney, Agent, or Firm*—Robert G. Upton

[57] ABSTRACT

A composite mini-extended nozzle is disclosed that is designed to both resist erosion and be strong enough to withstand the shock of a downhole drilling environment. In addition, means are provided to shroud at least a portion of the extended nozzle to further protect a portion of the nozzle nearest the exit plane from downhole obstructions. A combination of materials used to form the nozzle may include a matrix of tungsten carbides with suitable binder joined to an outer metal jacket nozzle body. A third ceramic matrix material may be utilized to line or partially line an interior passage formed by the mini-extended nozzle and a reduced in diameter portion of the nozzle design may include a built-in fracture plane in the unlikely event the end of the nozzle hits an obstruction. The extended portion of the nozzle will shear off along this fracture plane thereby preventing a nozzle washout that likely would result in a trip out of the hole to repair the resultant damage to the rock bit.

4 Claims, 4 Drawing Sheets

COMPOSITE NOZZLES FOR ROCK BITS

BACKGROUND OF THE INVENTION

1. Field of the Invention

This invention relates to replaceable nozzles for rock bits utilizing drilling mud to remove detritus from an earthen formation borehole.

More particularly, this invention relates to mini-extended nozzles that are fabricated from a composite of materials to both resist erosion of the nozzle from the drilling mud and to prevent nozzle breakage caused by contact of the nozzle tip with obstructions in the formation borehole during a drilling operation.

2. Background

Extended nozzles of varying length have been used in petroleum bits for several years. Obviously, the longer the nozzle is the more vulnerable it is to breakage since the extended end is normally unsupported.

Moreover, composite hydraulic nozzles have been developed and patented by others in the rock bit industry.

U.S. Pat. No. 3,111,179 teaches the fabrication of a jet nozzle of composite material. The nozzle consists of a thin walled inner shell of tungsten carbide material that is bonded to a plastic body. The body serves to back up and support the erosion resistant but brittle tungsten carbide inner shell. The patent further teaches that, should the nozzle be ejected from the rock bit, it would easily be ground up by the cutter cones and removed from the borehole along with the formation cuttings since the hard shell is brittle and the back up material is relatively soft.

This nozzle could not be readily extended since the back up material taught would not be strong enough to support the thin inner shell.

U.S. Pat. No. 4,392,534 discloses a composite nozzle for earth boring bits. The nozzle consists of a ceramic body encased within a thin metal cylindrical shell and a metal reinforcing end plate at the nozzle exit plane. This nozzle also is disadvantaged in that it lacks sufficient support to withstand an exposure to the rock formation should the nozzle be extended beyond the bit body.

U.S. Pat. Nos. 4,665,999; 687,067; and 4,711,311 assigned to the same assignee as the present invention all reflect rock bit nozzle designs and are incorporated herein by reference.

The '999 reference teaches the use of standard nozzles mounted within extended portions of the bit body. The '067 patent is a mini-extended nozzle fabricated entirely of tungsten carbide and the '311 reference is a means to retain a nozzle body within a nozzle receptacle formed in the bit body.

The mini-extended nozzle taught by the '067 reference, while its performance is outstanding, is vulnerable to breakage should the extended end of the nozzle encounter an obstruction downhole. Should the nozzle break, nozzle washout is a possible consequence.

The present invention overcomes the inadequacies of the foregoing prior art by providing a composite mini-extended nozzle that will withstand the harsh environment downhole. A means is also provided to further protect the extended portion of the nozzle body to insure the integrity of the nozzle.

An additional means is disclosed to vary the length of the nozzle support body to further vary the distance of the exit plane of the mini-extended nozzle with respect to a borehole bottom.

SUMMARY OF THE INVENTION

It is an object of this invention to provide composite extended nozzle designs that are strengthened and made erosion resistant to prevent or alleviate nozzle breakage.

It is another object of this invention to provide a specific break line downstream of the nozzle throat that serves to prevent a bit washout in the unlikely event the extended portion of the nozzle suffers a catastrophic failure.

It is still another object of this invention to provide a shroud to protect the nozzle portion that extends beyond the body of the bit.

It is yet another object of this invention to provide an intermediate nozzle retention body that serves to extend the exit of the nozzle closer to a borehole bottom.

The composite nozzle is composed, for example, of two or more dissimilar materials to tailor the properties to meet specific design related requirements.

The mini-extended nozzle is specifically designed with steel, composite matrix and tungsten carbide or any combination of each. The internal layers of the nozzle are, for example, composed of a composite matrix material and/or tungsten carbide. The outer layers are composed of steel with carbide and or a composite matrix. Each of the materials outlined above has unique properties that make each of them most ideal for specific locations on the nozzle. Tungsten carbide is ideally suited for locations where excellent wear resistance is required. The matrix material has a good combination of toughness and wear resistance. And finally, the steel has excellent tensile strength, impact strength and toughness.

The mini-extended nozzles may also incorporate in the design a means whereby the extended end of the nozzle will shear off downstream of the nozzle throat if the nozzle tip should encounter an obstacle down hole, thereby preventing washout of the nozzle body thus requiring an expensive trip out of the borehole to repair the damage or replace the washed out bit.

In addition, an alternate method is disclosed to protect the extended, slimmed down [reduced in diameter] portion of the nozzle from breakage. A protective shroud is fabricated from, for example, steel and concentrically contains and extends over a portion of the slim end of the nozzle.

Moreover, the interior cylindrical portion of the shroud is purposefully spaced from the exterior portion of the extended nozzle and the shroud axially extends about half way down the slim portion of the nozzle. The annular space between the shroud and the extended portion of the nozzle allows the shroud limited lateral motion without contact with the outer wall formed by the nozzle.

An advantage then of the composite extended nozzle over the prior art is the combination of materials that both resist erosion, provide resistance to impact and provide toughness where necessary.

Another advantage of the composite extended nozzle over the prior art is the means by which the end of the extended portion of the nozzle shears in a controlled manner to prevent nozzle washout in the event breakage should occur.

Still another advantage of the composite extended nozzle over the prior art is the addition of a protective metal shroud to prevent breakage of the nozzle that is spaced from, concentically contains and extends at least half way down the slim extended portion of the nozzle.

Yet another advantage of the present invention over the prior art is the means by which the nozzle retention body may be varied to adjust the exit end of the mini-extended nozzle a desired distance from a borehole bottom for optimum performance of the nozzle.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
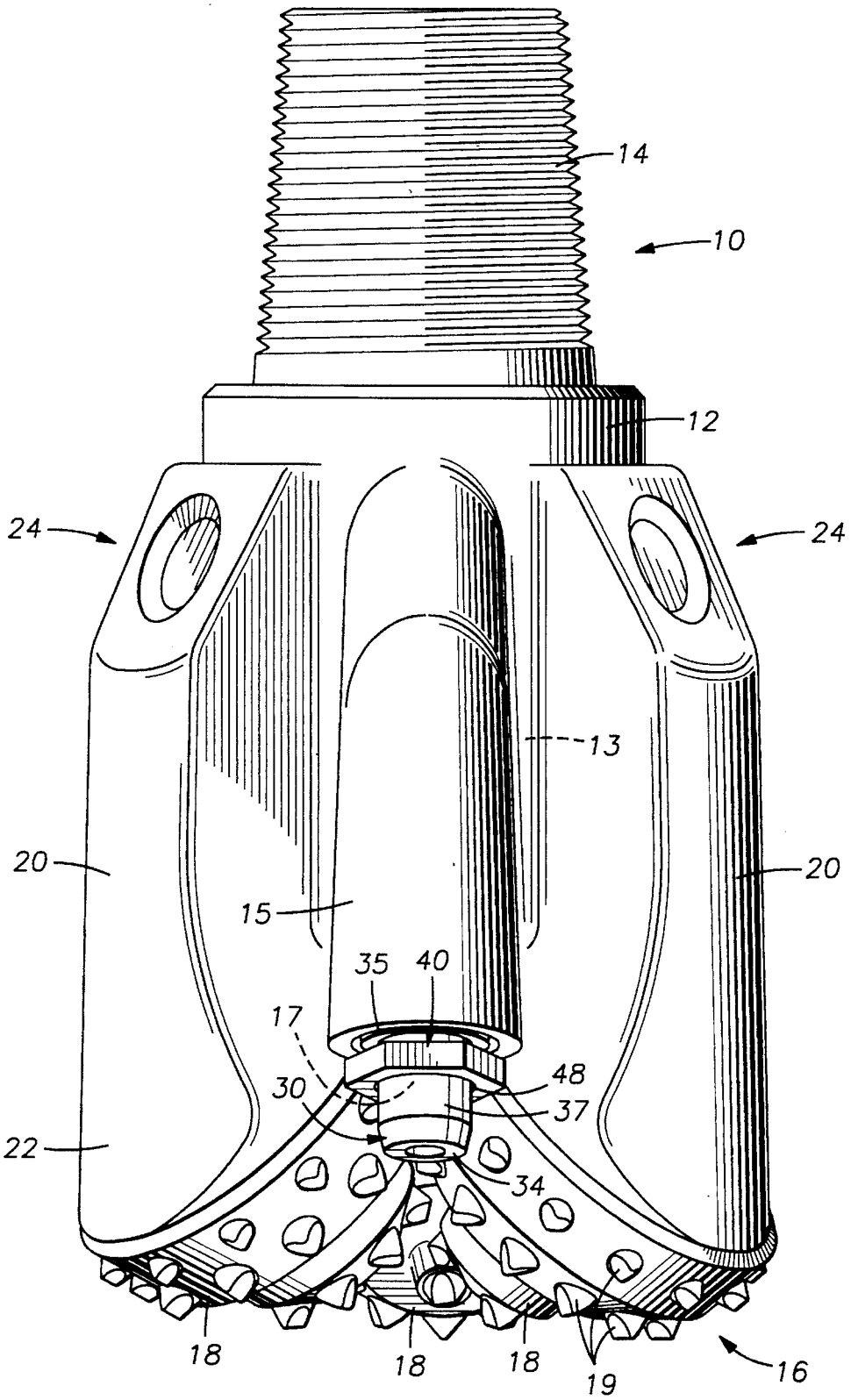
FIG. 1 is a perspective view of a typical three cone rock bit with mini-extended nozzles protruding from the bit body.

With reference to FIG. 1, the rotary cone rock bit generally designated as 10 consists of rock bit body 12, pin end 14 and a cutting end, generally designated as 16. A fluid chamber 13 is formed within bit body 12. The fluid chamber 13 communicates with the open pin end 14 so that hydraulic fluid may enter the rock bit body through an attached drillstring [not shown]. A dome portion 17 defines a portion of the fluid chamber 13 within body 12. Rock bit legs 20 extend from bit body 12 toward the cutting end of the bit. A cutter cone 18 is rotatably fixed to leg 20 through a journal beating extending into the cone from shirtail 22 of the leg [not shown].

Each cone 18, for example, has a multiplicity of cutter inserts 19 equidistantly spaced around each of the cones 18.

A lube reservoir system 24 supplies a lubricant to beating surfaces defined between the interior of the cones 18 and the journal.

A mini-extended nozzle, generally designated as 30, is shown protruding from a nozzle retention portion formed in a dome 17 of bit body 12.

As few as one and as many as four mini-extended nozzles 30 may be supported by a nozzle retention body 15 adjacent to the bit dome 17. Typically, three nozzles 30 are positioned about 120 degrees apart around the outer periphery of the dome 17 and one center jet nozzle is positioned in the dome to prevent or minimize "balling" of the bit [not shown].

Figure 2:
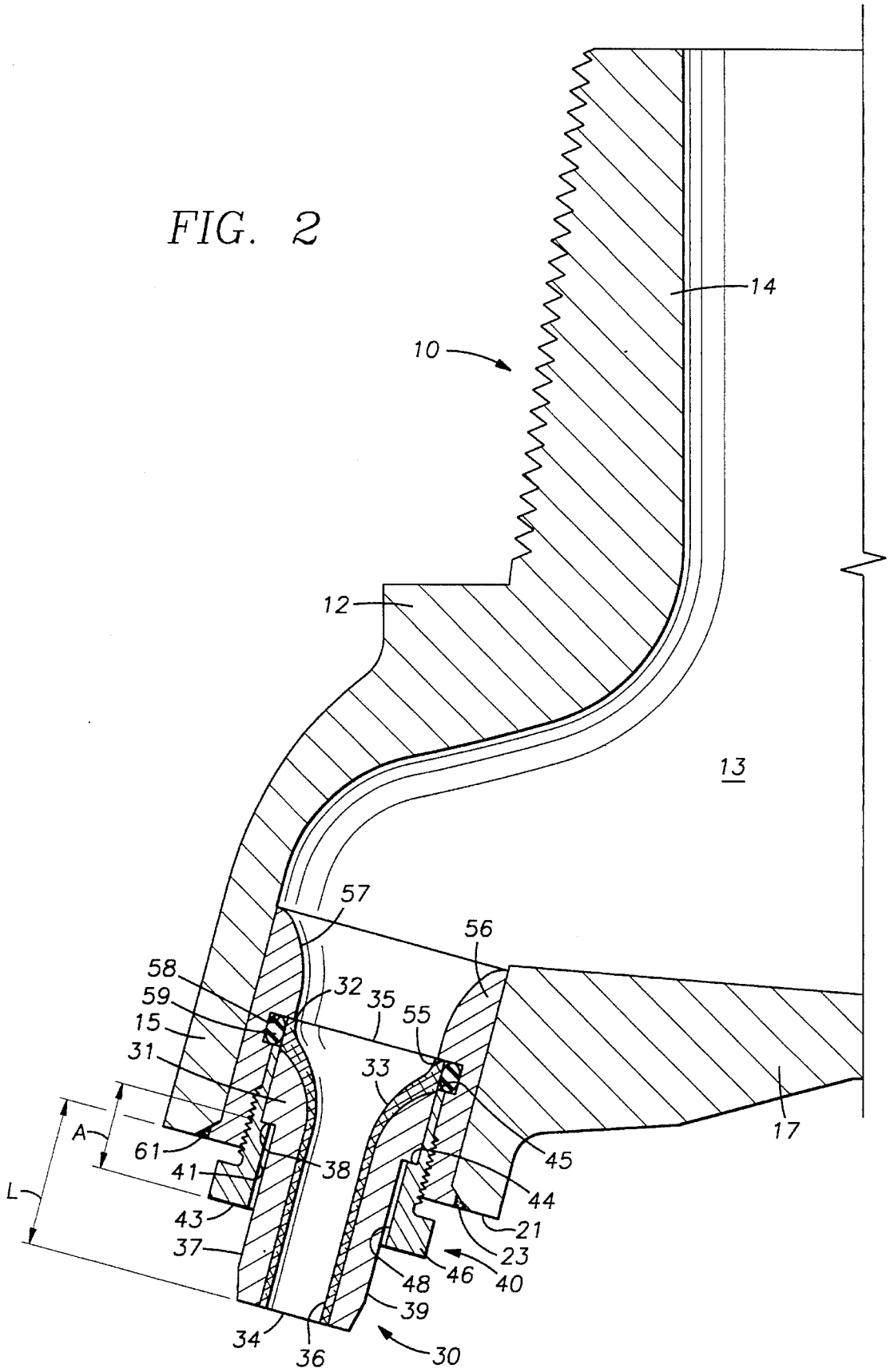
FIG. 2 is a cutaway segment of one leg of the roller cone rock bit illustrating the inner plenum chamber that directs drilling fluid through the nozzle.

With reference now to FIG. 2, the sectioned leg 12 of bit 10 forms a plenum chamber 13 that directs drilling fluid into the pin end 14 toward the inlet 57 of nozzle retainer sleeve 56. The sleeve 56 is designed to provide a receptacle for the mini-extended nozzles 30 and its threaded nozzle retention shroud generally designated as 40. The sleeve, for example, is welded into the nozzle retention body Weld 61 secures the sleeve 56 within the opening 23 of body 15. The sleeve further forms a support shoulder 55 that seats the upstream or entrance end 35 of the nozzle 30. In addition, an annular seal gland or groove 58 is formed adjacent to the end 35 of the nozzle 30. An O-ring 59 retained within the seal gland 58 prevents fluid from washing out the nozzle from the inside.

The threaded retainer shroud 40 is designed to extend a distance from a planar surface 21 formed by nozzle port 15 of bit body 12. Distance "A" represents a section of the slim portion 37 of the nozzle that coincides with shoulder 38 of the nozzle 30 to the end 43 of the shroud 40. Distance "L" represents the total distance of the extended portion 37 of the mini-extended nozzle 30 to the exit end 34 of the nozzle.

An annular space 48 separates the exterior wall 39 of the nozzle from the interior wall 41 of the shroud to allow the shroud to absorb the shock of contact with an object downhole without damage to the nozzle. The extended, slimmed down or reduced-in-diameter portion of the nozzle 37 begins at shoulder 38 of the nozzle 30 to the exit 34 formed by the nozzle hence, the nozzle shroud 40 protects about 50 percent of the extended portion 37 of the nozzle.

It would be obvious to eliminate the annular space between the shroud and the extended portion of the nozzle without departing from the scope of this invention.

The shroud forms an internal shoulder 44 that seats against an annular complimentary shoulder 38 formed by nozzle 30. The cylindrical upstream end 45 formed by the shroud serves to close out gland 58 of sleeve 56 and the opposite end 43 forms, for example, a hex head for ease of mechanically securing the shroud into the sleeve 56.

The nozzle 30 is, for example, formed of a steel body 31 with a hard, erosion resistant matrix interior 36. The material 36 could, for example, be tungsten carbide or any combination of tungsten carbide and ceramic thereof. Alternative nozzle material combinations will be taught with reference to FIGS. 3 thru 5.

The upstream entrance plane 35 of the mini-extended nozzle 30 is designed to provide an uninterrupted flow of fluid from the plenum chamber 13 into the interior of the nozzle past restricted throat 33 and out through exit 34 of the nozzle.

Figure 3:
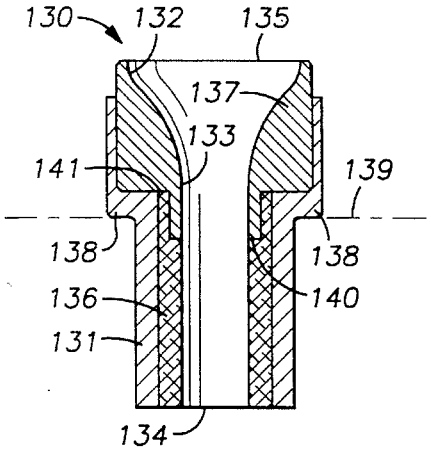
FIG. 3 is a cross-section of a composite mini-extended nozzle illustrating a tungsten carbide nozzle throat portion, a ceramic matrix material downstream of the throat and a steel jacket enclosing the composite material.
Figure 4:
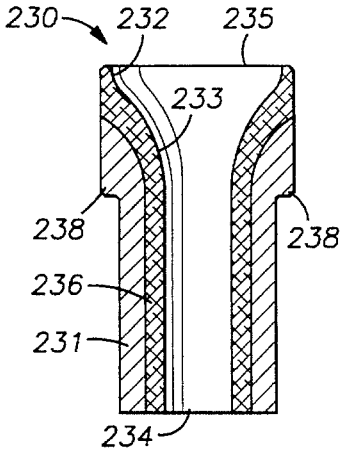
FIG. 4 is a cross-section of an alternative mini-extended nozzle having a steel jacket with a tungsten carbide matrix interior.
Figure 5:
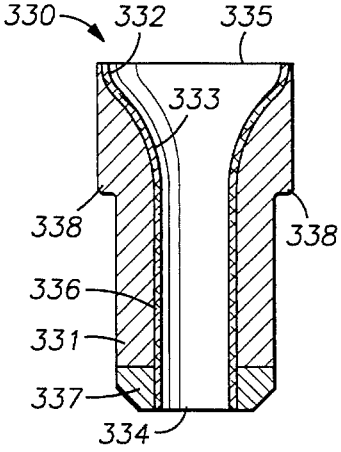
FIG. 5 is a cross-section of yet another alternative mini-extended nozzle disclosing a mini extended nozzle having a ceramic liner with a ceramic cap adjacent the exit plane of the nozzle, the ceramic end of the nozzle serving to minimize erosion.

Turning now to FIGS. 3, 4, and 5 the alternative mini-extended nozzles illustrated are examples of various material combinations that may be utilized to fabricate the nozzles.

FIG. 3 depicts a nozzle generally designated as 130 having a steel body jacket 131. An upstream portion forming entrance 132 is formed from erosion resistant tungsten carbide that extends past and forms the throat 133 of the nozzle 130. The interior portion downstream of the throat 133 is fabricated from a matrix material 136 that may include a ceramic composite mix.

A shoulder 138 is formed in the steel jacket. The plane of the shoulder 138 is substantially aligned with a plane 139 that intersects the downstream end 140 of the tungsten carbide portion 137 and the upstream end 141 of the ceramic portion 136. In the unlikely event that the end 134 of the extended nozzle 130 encounters an obstacle downhole large enough to fracture the nozzle, it will break along the break line 139 coincident with the plane formed along shoulder 138. Hence, the integrity of the major portion of the nozzle will remain intact and the nozzle will not wash out causing the bit to be tripped from the hole for repair or replacement.

FIG. 4 illustrates an alternative nozzle 230 having a steel body 231. An inner liner formed from a matrix material 236 extends from upstream portion 232, past throat 233 to exit 234. The liner 236 is an erosion resistant matrix material such as a matrix of tungsten carbide. An annular shoulder 238 formed in steel body 231 provides a seat for the nozzle retainer shroud 40.

The matrix material is, for example, a mixture of tungsten carbide materials (WC and/or cast carbide $W_2$/WC) in an infiltrating binder. A typical binder material is a copper based material alloyed with Ni, Mn, Zn and sometimes used in addition with or substituted with Sn or Fe. Alternatively, the above carbide could be replaced with sintered crushed carbide (WC+Co) and/or conventionally carburized carbide (WC) or macrocrystalline carbide (WC) with equivalent results without departing from the scope of this invention.

FIG. 5 depicts yet another alternative nozzle 330 with a steel body 331 outwardly forming an annular shoulder 338. This nozzle is lined internally with, for example, a layer of ceramic material 336 that extends from entrance 332 to the exit 334. An annular ceramic ring 337 caps the exit nozzle 334 for added erosion protection.

Figure 6:
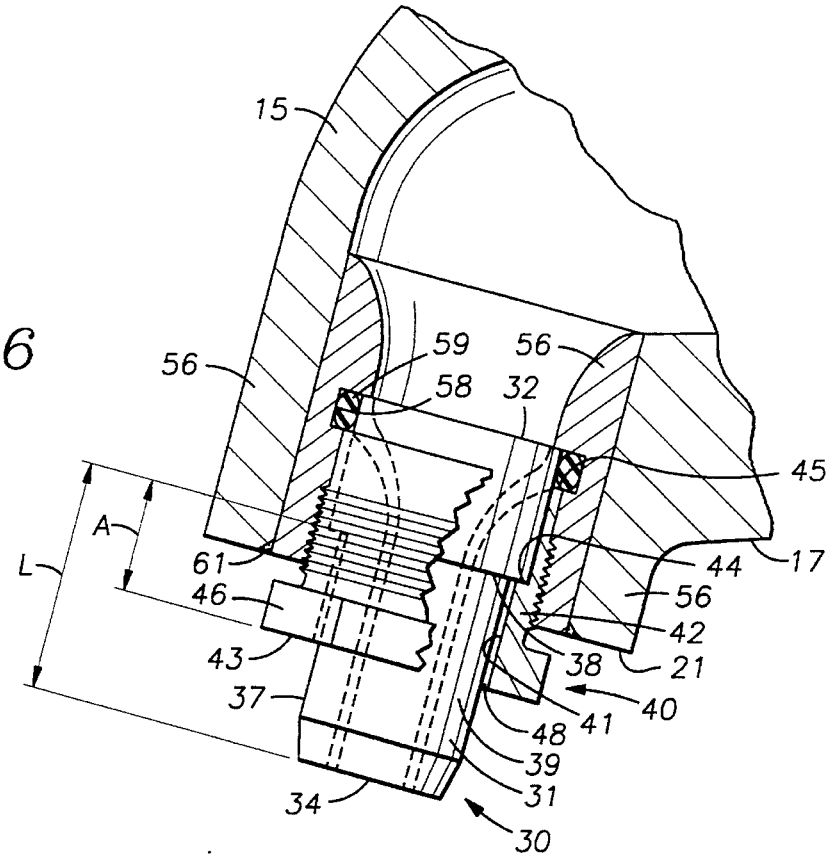
FIG. 6 is a cross-section of a nozzle retainer shroud designed to protect the extended end of the nozzle.

With reference now to FIG. 6, the partially broken away nozzle retention shroud 40 is threaded into sleeve 56; shoulder 44 seating against annular shoulder 38 formed on the nozzle body 31. The cylindrical upstream end 45 formed by the body 42 ends substantially at the seal gland 58. The hexagonal opposite end 46 forms a cylindrical passage through surface 43 that is annularly spaced from the exterior wall of the nozzle [48]. As heretofore stated, the annular space 48 allows for slight lateral movement of the shroud without contacting the nozzle for added nozzle protection.

The shroud 40 is designed to protect the nozzle from breakage by surrounding the slim section of the nozzle 30. The shroud can be made from any machinable steel, or like material, that provides the desired properties of strength to protect the nozzle from breakage. Since the shroud is located around the outside of the nozzle, it has better mechanical properties [larger moment of inertia] to protect the nozzle. The properties of the nozzles are constrained to be very wear resistance due to the abrasiveness of the fluid or drilling mud that flow at high velocity through it. The shroud 40 is not constrained to be highly wear resistant which allows a better selection of materials to protect the mini-extended nozzle from impact breakage.

The percent coverage of the shroud 40 over the extended portion 37 of the nozzle is defined by A/L * 100 and should be within the range of 10 percent to 100 percent. FIG. 6, for example, illustrates a shroud that protects 50 percent ["A"] of the extended slim section of the nozzle 30 ["B"].

Figure 7:
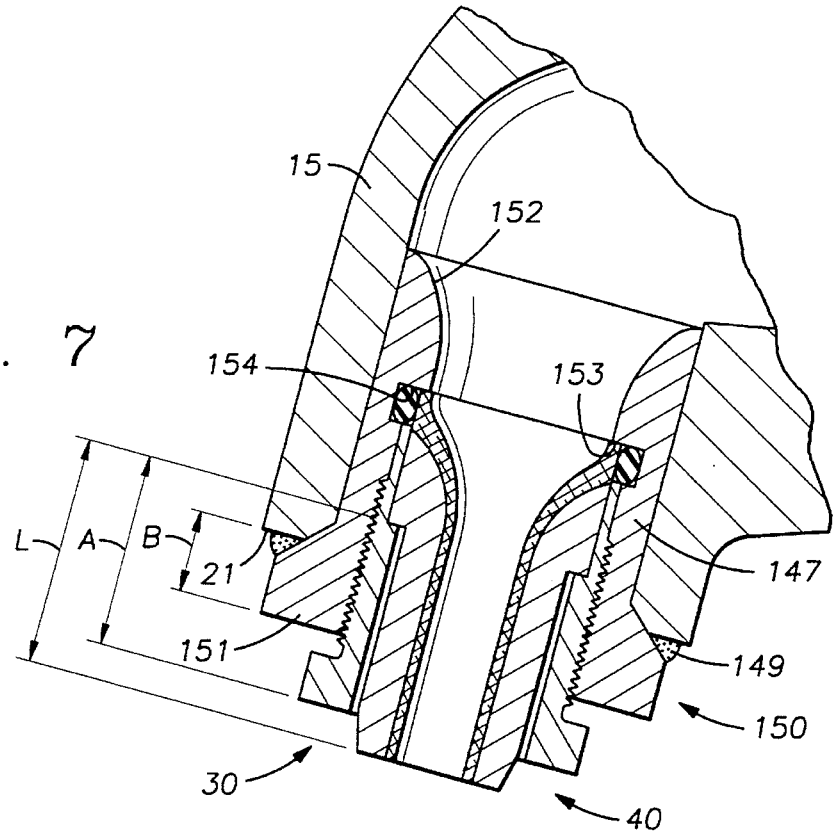
FIG. 7 is a cross-section of a nozzle with a protective sleeve shroud and a retainer shroud secured within the sleeve, the retainer shroud extending close to the exit plane of the nozzle.

FIG. 7 teaches an alternative nozzle retention means that provides for even more nozzle protection. A sleeve shroud generally designated as 150 comprises a sleeve body 147 that forms an extended flange portion 151 that protrudes a distance "B" from surface 21 of bit body 12. Otherwise the sleeve is identical to sleeve 56 described with respect to FIGS. 2 and 6.

The nozzle 30 and shroud 40 mount within the extended sleeve 150. This combination results in about an 80 percent coverage of the extended portion of the nozzle thus substantially protecting the entire nozzle.

Sleeve 150 is, for example, welded through surface 21 at juncture 149 thus securing the sleeve within the nozzle port 15 formed in body 12 of the rock bit 10.

Figure 8:
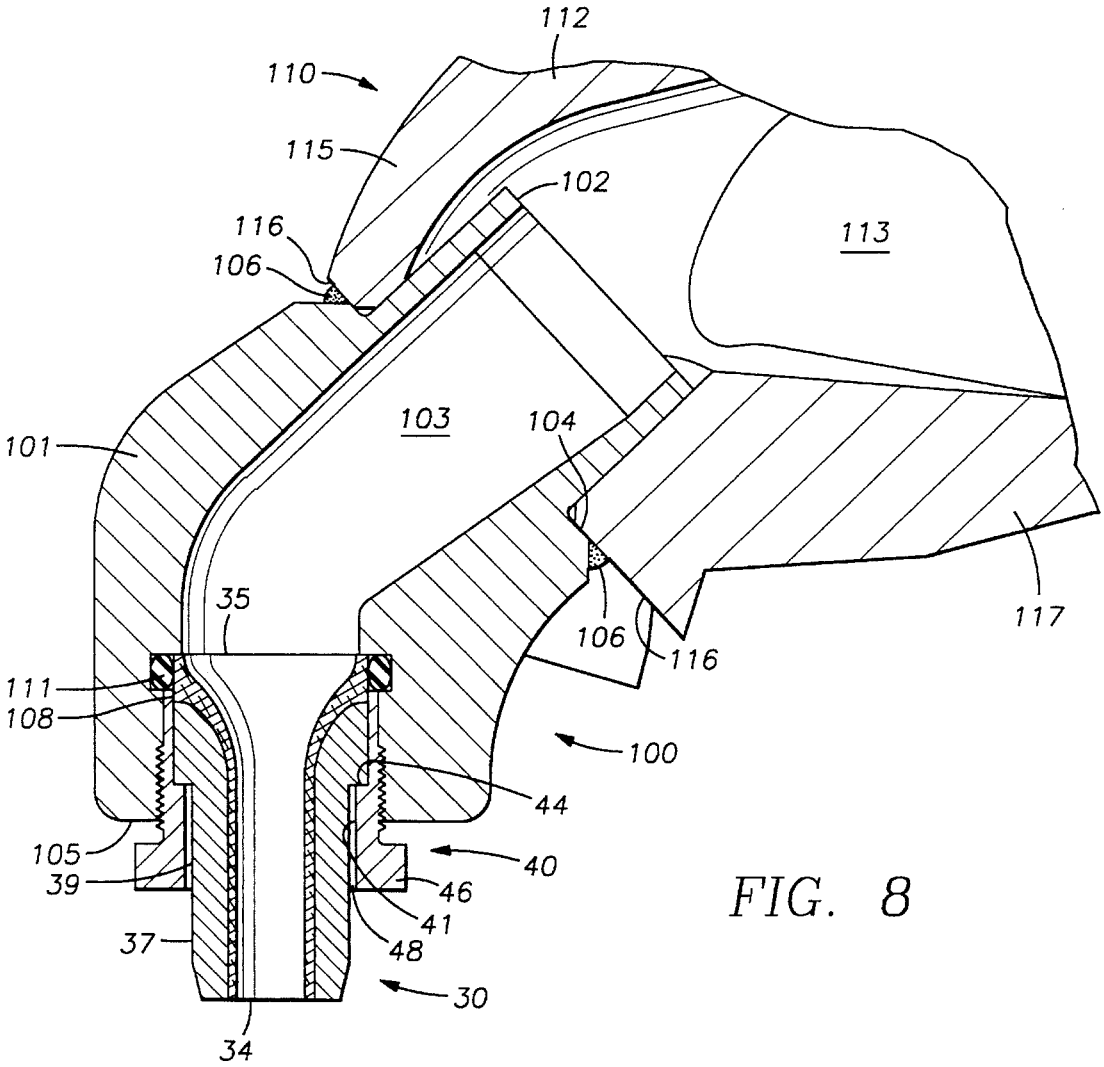
FIG. 8 is a cross-section of yet another variation of the mini-extended nozzle illustrating an extended portion of the nozzle retention body that is metalurgically bonded to the dome of the bit body to enable a wide variation of nozzle extension relative to a borehole bottom while utilizing the basic composite mini-extended nozzle.

FIG. 8 is an alternative means to project a mini-extended nozzle closer to a borehole bottom utilizing the basic nozzle retention and protection means described heretofore.

A separate nozzle retention segment generally designated as 100 consists of, for example, an "elbow" shaped steel body 101. Body 101 forms upstream end 102 that directs fluid into passage 103. The opposite end 105 of body 101 may be extended any desired length from dome 117 of the bit 110 depending upon the limitations set by the mini-extended nozzle mounted therein. Body 101 forms a shoulder 104 that is seated to planar surface 116 formed at the base of nozzle retention portion 115 of bit body 112. Weld 106 secures the extended segment 100 to the bit adjacent dome 117.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A nozzle retention shroud designed to retain an extended nozzle mounted within a rock bit and to protect an extended portion of said nozzle that protrudes beyond a body of the rock bit from breakage during operation of said rock bit within a borehole, said shroud comprising;

a cylindrical body forming a first upstream open end and a second open exit end, an outer wall formed by said body forming means to secure said shroud within the rock bit, an interior wall formed by said body forming a means to secure said extended nozzle between said shroud and said rock bit, said second open exit end concentrically surrounds and extends over an extended portion of said nozzle protruding beyond the bit body a sufficient distance to protect said extended portion of the nozzle from contact with an obstruction exterior to said rock bit.

2. The invention as set forth in claim 1 wherein said shroud extends over said extended portion of said extended nozzle from about 50 percent to 100 percent.

3. The invention as set forth in claim 1 wherein an annular space is formed between said interior wall formed by said shroud and said exterior wall formed by said extended portion of said extended nozzle, said annular space allows for some lateral movement of said shroud surrounding said extended portion of said nozzle.

4. The invention as set forth in claim 1 further comprising a shroud retaining sleeve that is secured within said nozzle retention aperture formed by said rock bit, said sleeve forming a first upstream opening that communicates with a fluid chamber formed by said rock bit and a second downstream opening that extend a distance beyond an exit opening of said nozzle retention aperture, said shroud retaining sleeve enables said shroud to further protect said extended portion of said extended nozzle by extending the shroud over the nozzle an added distance equal to the distance said sleeve extends past said exit opening of said nozzle retention aperture.

* * * * *